US010975592B2

(12) United States Patent
Smith et al.

(10) Patent No.: US 10,975,592 B2
(45) Date of Patent: Apr. 13, 2021

(54) BARRIER CONNECTION SYSTEM AND METHOD THEREOF

(71) Applicant: Three Smith Group Limited, Elland (GB)

(72) Inventors: Luke Smith, Elland (GB); Dean Cowan, Elland (GB)

(73) Assignee: THREE SMITH GROUP LIMITED, West Yorkshire (GB)

( * ) Notice: Subject to any disclaimer, the term of this patent is extended or adjusted under 35 U.S.C. 154(b) by 656 days.

(21) Appl. No.: 15/113,375

(22) PCT Filed: Jan. 21, 2015

(86) PCT No.: PCT/GB2015/050129
§ 371 (c)(1),
(2) Date: Jul. 21, 2016

(87) PCT Pub. No.: WO2015/110805
PCT Pub. Date: Jul. 30, 2015

(65) Prior Publication Data

US 2017/0009484 A1 Jan. 12, 2017

(30) Foreign Application Priority Data

Jan. 21, 2014 (GB) ..... 1401016
Jan. 21, 2014 (GB) ..... 1401017
(Continued)

(51) Int. Cl.
*E04H 17/14* (2006.01)
*E01F 13/02* (2006.01)
*E01F 15/04* (2006.01)

(52) U.S. Cl.
CPC ..... *E04H 17/1413* (2013.01); *E01F 13/02* (2013.01); *E01F 13/022* (2013.01);
(Continued)

(58) Field of Classification Search
CPC ..... E04H 2017/1452; E04H 17/1413; E04H 17/1421; E01F 15/04; E01F 15/0453;
(Continued)

(56) References Cited

U.S. PATENT DOCUMENTS 911,863 A * 2/1909 Adams ..... F16B 12/54 5/283
1,061,487 A * 5/1913 Moore ..... A47C 19/022 5/280
(Continued)

FOREIGN PATENT DOCUMENTS

DE 1684577 A1 * 12/1969 ..... E04B 1/5843
DE 2 244 055 A1 3/1974
(Continued)

OTHER PUBLICATIONS

Mar. 2, 2017 Office Action issued in British Patent Application No. 1401020.1.
(Continued)

*Primary Examiner* — Matthew R McMahon
(74) *Attorney, Agent, or Firm* — Oliff PLC

(57) ABSTRACT

A barrier having first and second spaced posts interconnected by a rail, wherein the rail and posts are not inserted within one another. In the exemplary embodiments, the parts are hollow in at least the region of the intended interconnection. Each post is connected to the rail by a coupling. Each coupling includes a connector that extends inside the hollow region of the post and rail. The post includes an aperture wherein when assembled the connector extends through the aperture. The connecter includes an abutment that abuts an inside of the post to prevent movement of the connector through the aperture. The connector is moveable further into one of the hollow sections of the post or rail to withdraw the connector from the other of the post or rail.
(Continued)

This allows the rail to be disconnected from the post without increasing the distance between the two spaced posts.

15 Claims, 9 Drawing Sheets

(30) Foreign Application Priority Data

Jan. 21, 2014 (GB) ..... 1401019
Jan. 21, 2014 (GB) ..... 1401020

(52) U.S. Cl.
CPC ..... *E01F 15/04* (2013.01); *E01F 15/0484* (2013.01); *E01F 15/0453* (2013.01); *E04H 17/1452* (2021.01)

(58) Field of Classification Search
CPC ..... E01F 15/0484; E01F 13/02; E01F 13/022; E04F 2011/1819; E04F 11/1817
USPC ..... 256/65.08; 403/255
See application file for complete search history.

(56) References Cited

U.S. PATENT DOCUMENTS 1,070,814 A * 8/1913 Kimball ..... F16B 12/54 5/283
1,125,670 A * 1/1915 Duke ..... F16B 12/56 5/304
1,972,997 A * 9/1934 Junkers ..... F16B 7/0453 403/237
2,941,855 A * 6/1960 Weill ..... F16B 12/40 403/237
3,129,965 A * 4/1964 Stark ..... F16B 12/40 403/217
3,574,367 A * 4/1971 Jankowski ..... B62D 33/044 403/201
4,101,226 A * 7/1978 Parisien ..... E04H 17/1413 403/4
4,142,809 A * 3/1979 Shell ..... F16B 12/34 403/201
4,238,117 A * 12/1980 Newman ..... B23K 33/006 256/65.1
4,355,919 A * 10/1982 Lievonen ..... F16B 7/0446 403/191
4,514,107 A * 4/1985 Moreno ..... F16B 2/14 403/230
4,556,337 A * 12/1985 Marshall ..... F16B 7/0473 403/255
4,574,552 A * 3/1986 Korth ..... F16B 7/0473 403/297
4,585,365 A * 4/1986 Manno ..... F16B 12/20 108/153.1
4,643,607 A * 2/1987 Caudill ..... F16B 3/00 403/194
4,714,369 A 12/1987 Souza, Jr.
4,799,819 A * 1/1989 Swoboda ..... E04B 2/766 403/252
4,923,322 A * 5/1990 Burg ..... F16B 7/0446 403/234
4,952,092 A 8/1990 Ballerstein
5,255,897 A * 10/1993 Pepper ..... E04H 17/1421 256/24
5,350,156 A * 9/1994 Cote ..... E04F 11/1834 256/59
5,354,037 A 10/1994 Venegas, Jr.
5,647,682 A * 7/1997 Riehm ..... F16B 7/0473 403/297
5,832,548 A * 11/1998 Moser ..... F16B 12/40 5/288
5,860,253 A 1/1999 Lapointe
6,106,183 A * 8/2000 Strassle ..... F16B 7/046 403/252
6,179,511 B1 * 1/2001 Gassler ..... E04B 2/766 403/170
8,408,835 B1 * 4/2013 Zhang ..... F16B 7/0473 403/255
8,613,412 B1 12/2013 Donaldson
9,441,356 B2 * 9/2016 Welcel ..... E04B 1/24
2009/0272957 A1 * 11/2009 Nelson ..... E04F 11/1834 256/65.01
2011/0277417 A1 * 11/2011 Welcel ..... E04B 1/24 52/653.1

FOREIGN PATENT DOCUMENTS

| | | | |
|---|---|---|---|
| DE | 28 17 768 | A1 | 10/1979 |
| DE | 3619993 | A1 | 12/1987 |
| DE | 197 12 100 | A1 | 6/1998 |
| EP | 0 097 727 | A1 | 1/1984 |
| EP | 0 341 218 | A1 | 11/1989 |
| FR | 2 925 560 | A1 | 6/2009 |
| GB | 1 553 785 | A | 10/1979 |
| GB | 2 068 499 | A | 8/1981 |
| GB | 2 433 285 | A | 6/2007 |
| JP | S61-062917 | U | 4/1986 |
| JP | H07-54515 | A | 2/1995 |
| JP | H08-260435 | A | 10/1996 |
| JP | 2013-060753 | A | 4/2013 |
| KR | 10-1213761 | B1 | 12/2012 |
| WO | 03/057575 | A2 | 7/2003 |
| WO | 2004/067369 | A1 | 8/2004 |
| WO | 2005/017262 | A1 | 2/2005 |
| WO | 2008/122291 | A1 | 10/2008 |
| WO | 2011/104527 | A1 | 9/2011 |

OTHER PUBLICATIONS

Apr. 14, 2015 International Search Report issued in International Patent Application No. PCT/GB2015/050129.
Aug. 28, 2018 Office Action issued in Japanese Patent Application No. 2016-547919.
Jul. 7, 2014 Office Action issued in British Patent Application No. 1401020.1.
Jul. 7, 2014 Office Action issued in British Patent Application No. 1401017.7.
Jul. 8, 2014 Office Action issued in British Patent Application No. 1401016.9.
Apr. 20, 2017 Search and Examination Report issued in British Patent Application No. 1401019.3.
Apr. 27, 2017 Office Action issued in British Patent Application No. 1401016.9.

* cited by examiner

BARRIER CONNECTION SYSTEM AND METHOD THEREOF

The present invention relates to a connection system for forming a barrier such as a safety barrier or the like and in particular, to an impact barrier to protect pedestrians or equipment from impact, for instance from vehicles.

Impact barriers are known where a series of posts are installed anchored to a ground surface. The posts can be interconnected by rails or the like to form a pedestrian, vehicular or other barrier. In such systems, in the event of an impact, the forces are transferred through the post and into the ground. The strength of the connection to the ground surface is therefore important and typically a strong anchor connection is required.

It is advantageous from a cost and reliability point of view that the posts and rails are formed from a high strength plastic material. Typically, these parts are extruded and cut to size.

To adequately act as an impact barrier, the posts and rails of the barrier must be secured together so as to remain connected during impact from a vehicle. It is known to secure plastic post and rails together using an interlocking arrangement as disclosed in EP1483160. Here a tubular post and rail are arranged to interconnect with each other by the rail having an opening which lies within the hollow interior of the post, and a third component inserted into the opening to lie within the hollow interior of the first component thus locking all three components together. This arrangement requires the rail to be a smaller size to the post so that the rail can fit through the post's aperture. Typically, to achieve the desired strength, the post is more than 20% bigger than the rail. When the rail and post fit within one another, if a section of the barrier becomes damaged and needs to be replaced, it is necessary to dissemble the entire barrier, even though only a small number of the posts and/or rails need to be replaced. This is particularly relevant where the rail fits within the post because here the posts at either end of the rail that needs to be replaced have to be moved apart to withdraw the rail.

Whilst the posts can be installed by burying part of the extrusion to anchor it directly to the ground, this is often not possible or desirable. Rather, usually a ground anchor is used such as disclosed in EP2539136, here the posts are secured to a foot plate that is then secured to the ground. Known foot plates are typically formed from metal such as steel. Here the footplates have a sleeve part that extends a substantial way up the length of the extrusion in order to receive and secure the plastic post. A plate part extends from the sleeve part at a generally orthogonal angle to the length of the sleeve so as to be parallel to the ground when the post is upright. The plate part extends outwards from the sleeve so that fixings can be secured there though to anchor the foot plate to the ground. For instance, typically the plate part is square and bolts are secured through holes in each corner. Known ground anchors secure the post and footplate in a fixed manner so that other than the flex in the post, the full force of the impact is transmitted through the ground anchor.

It is an object of the present invention to attempt to overcome at least one of the above or other disadvantages. It is a further aim to provide an impact barrier with improved manufacturability, improved installation and improved reparability. It is a further aim to provide improved connection between the post and ground anchor, and post and rail.

According to the present invention there is provided an impact barrier and method of assembling and repairing an impact barrier as set forth in the appended claims. Other features of the invention will be apparent from the dependent claims, and the description which follows.

In the exemplary embodiments barriers are described having posts and rails. Typically the element connected at a distal end is termed the post and the element connected at a mid section along its length is termed the rail. The posts and rails are typically interconnected perpendicularly to each other to form the barriers. However, other angles are envisaged. The posts and rails are suitably hollow, however, solid elements with suitable hollow sections are also envisaged. Moreover, although the exemplary embodiments are described in relation to tubular elements having a circular cross-section, other cross-sections such as square or rectangle or other geometric shape are envisaged as well as combinations of the same. Typically the posts and rails are extruded to form hollow elements having constant cross-section. Though other manufacturing methods are possible. In the exemplary embodiments, the posts and rails are formed from a plastics material. Metal or other suitable materials are also possible. Indeed, the barrier systems described herein provide an improved connection method between the posts and rail and post and footplate, and the general design and construction of other parts of the barrier system may include compatible features and constructions as known in the art.

According to a first aspect there is provided a barrier having first and second spaced posts interconnected by a rail, wherein the rail and posts are not inserted within one another. In the exemplary embodiments, the parts are hollow in at least the region of the intended interconnection. Each post is connected to the rail by a coupling. Each coupling includes a connector that is arranged to extend inside the hollow region of the post and inside the hollow region of the rail. Here, the post includes an aperture wherein when assembled the connector is arranged to extend through the aperture. The connecter includes an abutment that abuts an inside of the post to prevent movement of the connector through the aperture. The connector is arranged to be moveable further into one of the hollow sections of the post or rail to withdraw the connector from the other of the post or rail. This allows the rail to be disconnected from the post without increasing the distance between the two spaced posts.

In the exemplary embodiments, the posts are interconnected by a single rail. However, it will be appreciated that the posts may be interconnected by at least one rail. Here other rails may be provided. In this case each of the plurality of rails between two respective posts is suitably interconnected as herein described. Moreover, it will be appreciated to those skilled in the art that although a minimum of two posts is required typically a barrier will comprise a plurality of sequentially spaced posts, where each intermediate post is connected to an adjacent post by a rail. End posts in the sequence are connected to one other post. Intermediate posts in the sequence are typically connected to two or more posts. Although the system has been described as requiring two posts, one or both of the posts may be a wall or other structure providing a fixed connection to the rail.

The abutment of the connector is arranged within the post and may suitably be arranged to contact the inside of the post once assembled or the abutment may be brought into contact during an impact and as the rail is urged to pull away from the post. In one embodiment, the abutment is fixed relative to the connector for instance the abutment is an integral piece of the abutment such as a bulbous head, or the abutment may be substantially permanently fixed within or to the connector such as a glued pin. In this embodiment, the connector is arranged to be withdrawn into the hollow section of the post. In other exemplary embodiments, the abutment is in removable contact with the inside of the post. That is, during normal use, the abutment contacts the inside of the post to prevent the connector from moving through the aperture. However, to disassemble the rail from the post, the abutment is removed from contacting the inside of the post so that the connector may be moved through the aperture to withdraw the connector from the post. For instance, here, the abutment may be a bulbous head wherein the bulbous head may be able to be restricted in size so as to pass through the aperture. The size restriction is suitably applied by a force angled and preferably perpendicular to the direction of withdrawal. The bulbous head may contact one side of the aperture and be flexed towards the other side or the bulbous head may include a slot in the direction of withdrawal into which two opposed sides of the bulbous head can flex.

Alternatively, in other embodiments, the connector comprises a main body and a moveable first fixing, wherein the fixing is able to be moved relative to the main body to move the fixing from an abutment position to a free position. Suitably the fixing is moveable in a direction at an angle and preferably perpendicular to the direction of withdrawal of the connector from the post. In some exemplary embodiments, the fixing is removable from the main body. For instance the fixing is a pin that can be moved into the main body or removed from the main body to free the abutment from contacting the inside of the post. In this case the first fixing is suitably an elongate pin. Here the pin may have a generally circular cross section. The pin may be rigid, or may include a force absorption feature as described in the third aspect.

In the exemplary embodiments, the part of the coupling that extends into the rail may have a substantial length such that when, in use, the rail is impacted and caused to pull away from the post, the coupling remains within the rail during the expected distance of travel. However, in this instance the length may be restricted if the connector is caused to move into the post, for instance because the abutment is fixed. Consequently, it is advantageous for the connector to include a second abutment. Wherein the second abutment acts on a part of the rail to retard movement of the rail away from the post. The second abutment may be fixed or removable as described in relation to the first abutment herein. In the exemplary embodiments, the second abutment acts through an aperture within the rail. Here, at least one of the abutments is in removable contact so that the abutment can be removed to allow the coupling to move into one of the post or rail.

In the exemplary embodiments comprising removable fixings, suitably the removable fixings extend, in use, from both sides of the coupling body.

Advantageously, because the posts and rail are not inserted within one another, the rail can be assembled or disassembled from the impact barrier without moving the posts. For example, with the posts secured in place the coupling can be assembled to one of the post or rail so that it extends fully within said post or rail. With the rail offered up to the post, the coupling can be moved to extend into the other of the post or rail. Here the first and second fixing members secure the coupling in place. In reverse, the at least one removable fixing member is removed allowing the coupling to be moved fully within one of the post or rail. The rail is therefore disconnected from the post and can be replaced without having to remove the post. Thus an improved installation method is provided and discrete sections of the impact barrier can be repaired without the need to disassemble comparatively large portions of the impact barrier.

In the exemplary embodiments wherein the coupling is arranged to move into the rail, the aperture through the post is advantageously smaller than the inner dimension of the rail. Consequently, the part of the coupling that extends into the post is smaller than the part of the coupling that extends into the rail. Here, the connector includes opposed ends, one of which is larger than the other and sized so as to fit within the rail and the other end is respectively smaller and sized so as to fit through the aperture. Advantageously, this allows the outer dimensions of the post and rail to be substantially the same giving a seamless appearance to the barrier. In these exemplary embodiments, the coupling includes a collar at the intersection between the end that is arranged within the post and the end arranged within the rail. The collar is suitably a raised ring. The raised ring is shaped to fit against the rail to one side and the post to the other and therefore provides a more seamless appearance.

In the exemplary embodiments, the first and/or second abutments retard movement of the respective post and rail to the coupling in a direction of movement of the rail being caused to pull away from the post. Whilst the abutments may be rigid to substantially fully retard the movement, this tends to create excessive forces within the barrier that can cause catastrophic failure in the coupling even upon relatively small impacts. Whilst the couplings are designed to be replaced after failure, in some instances, it is advantageous to provide the fixing with an energy absorption feature so that the coupling can dissipate some of the energy from an impact by allowing some movement within the connector. Consequently, it is advantageous if one or both abutments act against a localised area of reduced resistance to deformation as described in the second aspect or if one or both abutments include an area having a reduced resistance to deformation to control movement of first and second opposed faces of the abutment and as described in relation to the third aspect.

Yet further, it may be beneficial to provide localised areas of reduced deformation on both sides of the abutment and on opposed sides of a shearing action caused by the rail pulling away from the post and as described in relation to the fourth aspect.

In the exemplary embodiments, the connector has been described as sliding within the rail to withdraw the coupling from the post. This may be achieved by a mechanical feature such as a handle on the connector extending through a slot of the rail. For instance the handle may be part of the second abutment. However, the connector may also be moved by finger walking the connector through an aperture, for instance the aperture available once a removable abutment has been removed.

According to a second aspect there is provided a barrier having a first part inserted into a second part and prevented from separating by a fixing member. The fixing member acts against a substantially rigid area of one of the parts to one side and against a localised area of the other of the parts having increased deformability to the opposed side relative to the insertion direction of the first and second parts.

Here the substantially rigid area is relatively rigid compared to the localised area of reduced resistance to deformability and includes the substantially rigid area being formed from plastic.

The first part may be a footplate and the second part may be a post. Alternatively, the first part may be a rail and the second part a post. Alternatively the first part may be a connector and the second part a post or rail such as in the first aspect.

Advantageously, in the event of a collision, instead of the two parts being held rigidly together that tends to cause a catastrophic failure of one or both parts, the fixing member slips by deforming the localised area of increased deformability. This slipping helps absorb and dissipate the energy from the impact and decreases the catastrophic failure of the parts.

In the exemplary embodiments, the localised area of increased deformability, or in other terms, the localised area of reduced resistance to deformability is a resilient area. Suitably, the area comprises a compressible material wherein the volume of the material decreases. Alternatively, the area comprises a deformable material that deforms whilst maintain substantially the same volume. Advantageously, when the localised area of increased deformability is resilient, the impact barrier can return to an undamaged state after impact.

In the exemplary embodiments, the localised area is formed by providing a slot and partially filling the slot with a second material, to leave at least an aperture for receiving the fixing. Here, the fixing acts against a surface of the slot to one side and against the localised area to the other. Depending on the material used, the localised area may be secured within the part for example with adhesive or mechanical fixing. If a compressible material is used, the material may substantially fill the slot once the fixing is in place. However, when using a deformable material, space is required for the material to deform into.

The localised area of increased deformability may be provided by the first part or the second part or both. In the exemplary embodiments, the first and second parts are formed from a plastics material. The first part including the localised area of increased deformability includes a pocket filled with a second material having increased deformability with respect to said part.

In one exemplary embodiment the fixing member is substantially rigid. However, the pin may also include some resilient deformability as explained in the third aspect. The fixing member is suitably an elongate member. Here the fixing member contacts the rigid portion of the first member either side of the localised area of increased deformability and in a direction angled to the insertion direction of the two parts. However, the fixing member may not necessarily be elongate and may have two parts, wherein the parts may be separate or integral. In the exemplary embodiments the fixing member is suitably shown as an elongate pin. However, other fixing members are envisaged, for instance a clip.

Yet further, the fixing has been described in the second aspect as acting against a relatively rigid area to one side. For instance the edge of the slot contacts the fixing to substantially move the fixing with the slot. Whilst this allows the two parts in parallel by deforming the localised area equally on both sides, it also allows the two parts to pivot relative to each other by deforming one side more than the other. Whilst a pivot provides an enhanced energy absorption feature, the fixing is required to be arranged parallel to a direction of impact. However, the pivot axis here is at an edge or outside of the second part. Consequently, and as described in the fourth aspect, the fixing may be arranged to act against a localised area of reduced deformability to both sides of a shearing force caused by the first and second parts attempting to move relative to each other and as described in the fourth aspect.

In one exemplary embodiment the fixing member acts against a relatively hard area of one of the parts to one side and against a localised area with reduced resistance to deformation of the other of the parts to the opposed side in an insertion direction of the parts. Suitably the localised area comprises a compressible material. Preferably the localised area comprises a deformable material. Preferably the relatively hard area is formed from plastic. Preferably the first part is a rail and the second part is a post. Preferably the first part is a connector and the second part is a post or rail. Preferably the localised area comprises a slot and a second material arranged to partially fill the slot to leave at least an aperture for receiving the fixing. Preferably the localised area is secured within the part. Preferably the localised area is secured with adhesive or mechanical fixing. Preferably the compressible material substantially fills the slot when the fixing member is arranged in place. Preferably the deformable material substantially fills a deformed space when the fixing member is arranged in place. Preferably the localised area is provided in the first part. Preferably the localised area is provided in the second part. Preferably the localised area is provided in both the first part and the second part. Preferably the first and second parts are formed from a plastics material. Preferably the localised area comprises a pocket, the pocket filled with a second material having reduced resistance to deformation with respect to the first part. Preferably the fixing member is substantially rigid. Preferably the fixing member is an elongate member. Preferably the fixing member comprises a first part and a second part. Preferably the fixing member is arranged to act against a localised area of reduced resistance to deformation to both sides of a shearing force, the shearing force caused by the first and second parts attempting to move relative to each other. Here a method of assembling a barrier comprising the steps of: inserting a first part into a second part, wherein the parts are prevented from separating by a fixing member; arranging the fixing member to act against a relatively hard area of one of the parts to one side and against a localised area with reduced resistance to deformation of the other of the parts to the opposed side in an insertion direction of the parts.

According to a third aspect there is provided an impact barrier having a first part inserted into a second part and prevented from separating by a fixing member. The fixing member having a first side that acts against an area of one of the parts and a second side, opposed to the first side in a direction of insertion relative to the insertion direction of the first and second parts, that acts against an area of the other of the parts. The fixing member being formed from a first area having a relatively high resistance to deformation and a second area having a relatively lower resistance to deformation. Wherein the first area forms at least one of the first or second sides. The second area being arranged so that in use and when an impact force acts to pull the first part from the second part, the second part controls movement of the first area towards the second area.

The area having a relatively high resistance to deformation is a hard area or a rigid area. The area having a reduced resistance to deformation is a soft or deformable area.

In the exemplary embodiments, the fixing member is substantially elongate. Here, the fixing member comprises a pin. Typically the pin is based on a substantially cylindrical shape though other shapes are possible.

In one exemplary embodiment, the first area and second areas are formed on opposed sides of the fixing member. For instance, the fixing member is an elongate pin and one side of the elongate pin is formed from a substantially rigid area and the other side is formed from a relatively softer area. The relatively softer area is caused to deform to control movement of the rigid area towards the outer surface of the softer area.

Again, the area of reduced resistance to deformation may be a compressible area or a deformable area. The area may preferably be resilient. When using a deformable material, space is required to allow the material to deform into. Consequently, in the exemplary embodiment, grooves are formed in the fixing or surface to provide space for the deformable material to move into. For example, the face of the fixing includes grooves such as elongate grooves in the surface of the softer material.

The fixing member is shaped so as to provide a large surface area in contact with the parts. Here, the fixing member includes flared sides from a generally circular profile wherein the flared sides allow the fixing member to conform more closely to the part it abuts thereby increasing the surface area.

In alternative exemplary embodiments, one of the areas is arranged to surround the other. For instance, the rigid area may provide both the first and second opposed sides. Here, the fixing member comprises a rigid body having a hollow. The softer material is arranged within the hollow. Again a compressible material may fill the hollow, but if a deformable material is used the material may only partially fill the hollow to allow space for the material to deform. In one exemplary embodiment, the hollow includes a central rigid area.

In one exemplary the first side and second sides are arranged to move towards each other wherein said movement is controlled by the second area. Preferably the fixing member is substantially elongate. Preferably the fixing member comprises a pin. Preferably the pin is substantially cylindrical. Preferably the first area and second area are formed on opposed sides of the fixing member, wherein the second area is arranged to deform to control movement of the rigid area towards an outer surface of the second area. Preferably the first area may be compressible. Preferably the first area may be deformable. Preferably the deformable material substantially fills a deformed space when the fixing member is arranged in place. Preferably grooves are formed in the fixing member to allow the deformable material to substantially fills a deformed space when the fixing member is arranged in place. Preferably elongate grooves are formed in the surface of the face of the area having a relatively low resistance to deformation. Preferably the fixing area has a large surface area in contact with the parts. Preferably the fixing area has flared sides from a generally circular profile wherein the flared sides are arranged to allow the fixing member to conform more closely to the part that the fixing member abuts. Preferably one of the areas is arranged to surround the other. Preferably the fixing member comprises a rigid body with a hollow core, wherein a softer material is arranged within the hollow core. Preferably the softer material may be compressible to fill the hollow core. Preferably the softer material may be deformable wherein the softer material partially fills the hollow core. Preferably the fixing member comprises a rigid body with a hollow core, wherein the hollow core includes a central rigid area. Here a method of assembling a barrier, the method comprising the steps of: inserting a first part into a second part, wherein the parts are prevented from separating by a fixing member; arranging the fixing member having a first side to act against an area of one of the parts and having a second side, opposed to the first side in a direction of insertion, to act against an area of the other of the parts; and arranging the fixing member formed from a first area having a relatively high resistance to deformation and a second area having an reduced resistance to deformation relative to the rigid area, wherein the first side and second side are arranged to move towards each other wherein said movement is controlled by the second area.

According to a fourth aspect there is provided an impact barrier having a first part inserted into a second part and prevented from separating by a fixing member. The two parts in use are caused to separate which generates a shearing force on the fixing member. A first localised area of one of the parts having reduced resistance to deformation acts to control movement of the fixing member relative to one of the parts as a result of the shear force. The localised area deforming to provide the control.

In the exemplary embodiments, a second localised area of reduced resistance to deformation is provided. Here the second area is provided so as to act to allow movement of the fixing pin relative to one of the parts in an opposed direction of shear and caused by one of the parts pivoting relative to the other. Corresponding third and fourth areas of reduced deformability may be provided on opposed sides of the fixing as to the first and second areas so as to accommodate an impact in two opposed directions.

In the exemplary embodiments, the fixing is an elongate pin that extends from both sides of the first part. Here, the elongate pin may extend through the first part and act against a localised area to one side. For instance, a pocket including a material with the required characteristics. The material may surround the elongate pin. For instance a ring of material may be inserted with a larger aperture in the first part. The first or second area may be provided on the second part or may be provided on the first part. The first and second areas may also be provided on the same part or on alternate parts.

In one exemplary embodiment, a second fixing is provided. The second fixing is arranged at an angle to the first and preferably perpendicular thereto. Suitably at least one of the first and second fixings may be formed in two parts to allow the first and second fixings to intersect on the same plane. In the exemplary embodiments, the first and second fixings are held rigid to each other so that pivotal movement of one of the fixings causes movement of the other. In the exemplary embodiments, the first and second fixings are interconnected by a ball. Here the ball is central to the first part and allows the pivot axis of the fixings to be arranged at the centre of the first part.

In the exemplary embodiments one of the first or second part is arranged to statically retain the fixings. That is the fixings are arranged within apertures of said part and abut relatively hard areas of the part on all sides. The other of the parts dynamically retains the fixing wherein the fixing is arranged within an aperture and contacts an area of said part having reduced resistance to deformation. Preferably, the fixing contacts two spaced areas across the fixing of each part. The part holding the fixing dynamically having a first area of reduced resistance to deformation on opposed sides at the respective two locations. In one exemplary embodiment, the part holding the fixing dynamically has an area of reduced deformation at both opposed sides of the fixing and at both spaced locations.

The first part suitably includes chamfered or tapered distal end relative to the insertion direction. The chamfers reduce point loading on the second part and encourage the second part to pivot relative to the first. Due to the material characteristics of the second part, the second part may also stretch as well as pivot.

In one exemplary embodiment of a barrier comprising; a first part inserted into a second part, wherein the parts are prevented from separating by a fixing member; the two parts act on the fixing member to produce a shear force when the second part is impacted and wherein a first localised resilient area of one of the parts acts to allow movement of the fixing member relative to one of the parts as a result of the shear force. Preferably a second localised resilient area, the second localised resilient area is arranged to allow movement of the fixing member relative to one of the parts, wherein the first and second resilient areas are spaced across the direction of insertion. Preferably a third and fourth localised resilient area arranged to allow movement in both directions. Preferably the fixing member is an elongate pin that extends from both sides of the first part. Preferably the first or second area is provided on the first part. Preferably the first or second area is provided on the second part. Preferably a second fixing member arranged perpendicularly to the first fixing member. Preferably at least one of the first or second fixing members are formed in two parts arranged to allow the first and second fixing members to intersect on the same plane. Preferably the first and second fixing members are held rigid to each other so that pivotal movement of one of the fixings causes movement of the other. Preferably the first and second fixing members are interconnected by a ball, the ball being arranged centrally to the first part to allow the pivot axis of the first and second fixing members to be arranged at the centre of the first part. Preferably one of the first or second part is arranged to statically retain the fixings, wherein the fixings are arranged within apertures of said part and abut relatively hard areas of the part on all sides. Preferably the first part has a chamfered or tapered distal end relative to the insertion direction arranged to reduce point loading on the second part and encourage the second part to pivot relative to the first. Preferably the second part may also stretch as well as pivot. Here a method of assembling and disassembling a barrier, comprising the steps of: inserting a first part into a second part, wherein the parts are prevented from separating by a fixing member; arranging the two parts to act on the fixing member to produce a shear force when the second part is impacted and wherein a first localised resilient area of one of the parts acts to allow movement of the fixing member relative to one of the parts as a result of the shear force.

The above aspects and exemplary embodiments of a barrier are suitably a safety barrier such as an impact barrier. However, the barriers may also be other barriers such as segregation barriers and partition barriers. Consequently the term impact barrier is a particularly exemplary field where the particular forces and requirements are onerous but the aspects may also be applied to any barrier field in which case the aspects refer to barriers.

Furthermore, it is envisaged that the various aspects and features thereof are interchangeable except where mutually exclusive. That is the features of any aspect may be preferable features of other aspects.

For a better understanding of the invention, and to show how embodiments of the same may be carried into effect, reference will now be made, by way of example, to the accompanying diagrammatic drawings in which.

Figure 1A:
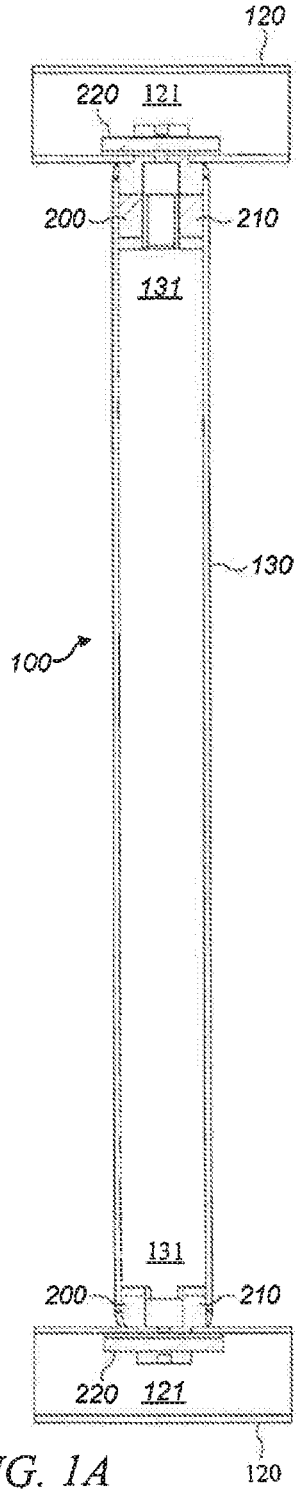
FIG. 1A shows a cross-sectional view of a barrier comprised of a rail between two posts in an assembled orientation.
Figure 1B:
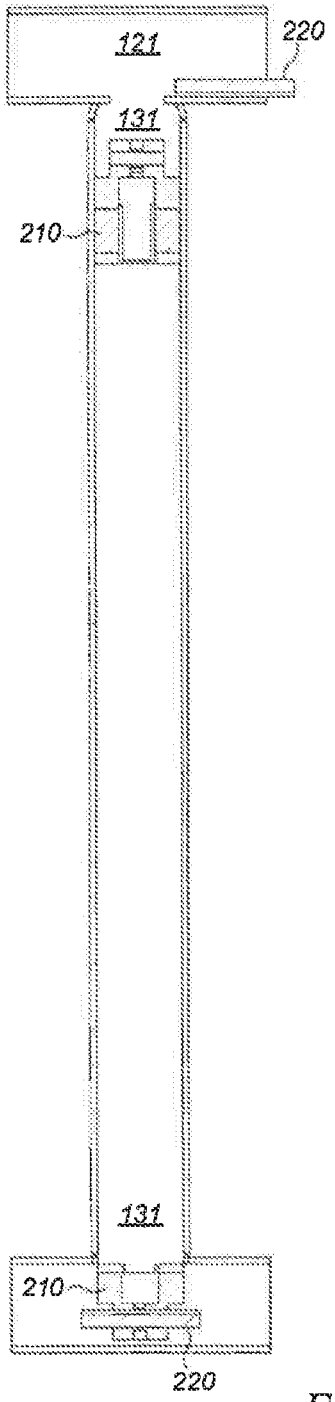
FIG. 1B shows a cross-sectional view of an arrangement ready for disassembling the rail from the posts.

Referring to FIG. 1A a barrier 100 is shown. The barrier comprises two spaced posts 120 and an interconnecting rail 130. The rail is connected to each post by a coupling 200. The rail and post are extruded tubular plastic elements and have hollow areas 131 and 121 at the intersection of the rail and posts. Each coupling 200 includes a connector 210 that extends into the hollow section of the post and the hollow section of the rail. The post therefore has a through hole into which the connector is inserted. An abutment 220 on the connector 210 abuts an inside surface of the hollow region 121 of the post. The abutment 220 is arranged to restrict the connector from moving through the through hole in the post. Consequently, when the rail is impacted during use, the rail moves away from the post but the length of the connector 210 ensures that the connector remains within the rail. During installation or if the rail or other component of the barrier requires replacement, the connector 210 is slid into only one of the hollow sections 131 or 121. For instance at one end the connector is shown in FIG. 1B as being moved into the post so that the connector no longer extends into the rail. As such, the abutment does not have to be removed from engagement and can therefore be a fixed head or glued pin. However, due to the space requirements this may restrict the length of the connector. Alternatively at the opposite end an alternative embodiment is shown wherein the abutment is removed from contacting the inside of the hollow post. This allows the connector to be slid entirely within the rail. Consequently the rail may be removed without having to uninstall the posts. A rail is installed by offering up the rail and moving the connectors back into the hollow area 131 of the rail. And the abutments brought into contact.

The sliding of the connectors can be done by manually reaching into the posts from the top or by using tools. Alternatively, the connector may have a handle for using to move the connector. Or a hole may be used to walk the connector along the rail.

The embodiment wherein the connector slides into the rail is advantageous as it allows the hole through the post to be sized smaller than the inside dimension of the rail. This allows a rail and post of the similar size to be utilised. However, the abutment needs to be arranged to be disengaged either by moving the abutment or by removing the abutment from the connector. As shown in FIGS. 1A and 1B, the abutment is suitably a first fixing such as an elongate pin that extends from both sides of the connector and is preferably removable from the coupling to remove the abutment from abutting the inside edges of the hollow area.

Figure 2A:
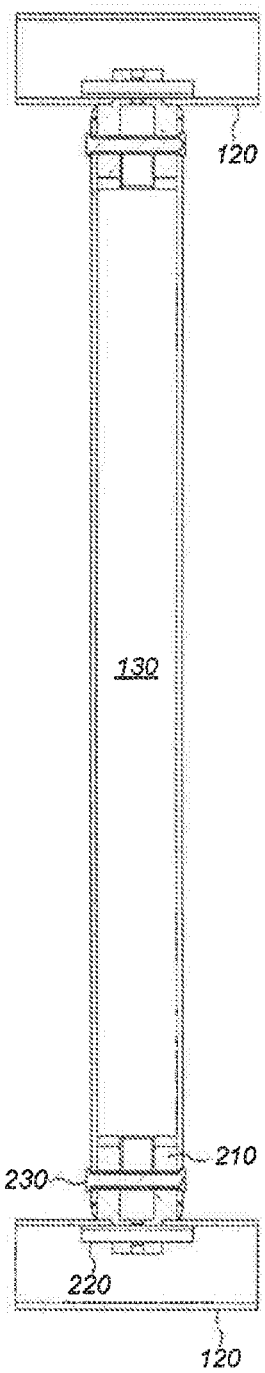
FIG. 2A shows a cross-sectional view of an alternative barrier comprised of a rail between two posts in an assembled orientation.
Figure 2B:
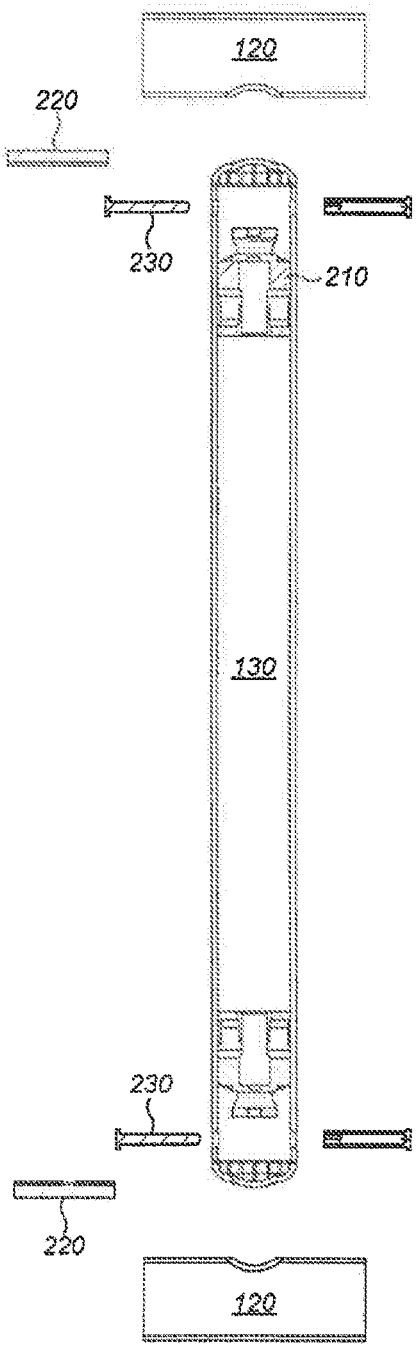
FIG. 2B shows a cross-sectional view of an arrangement ready for disassembling the rail from the posts.

FIGS. 2A and 2B show an alternative embodiment wherein a second abutment 230 on the connector also abuts the rail 130. Here both abutments need to be removed before sliding the connector out of contact with one of the parts, shown as the posts. Again, the abutment is shown as a removable fixing such as a pin 230. The pin is elongate and extends through an aperture of the connector so as to abut the rail on both sides.

Figure 3:
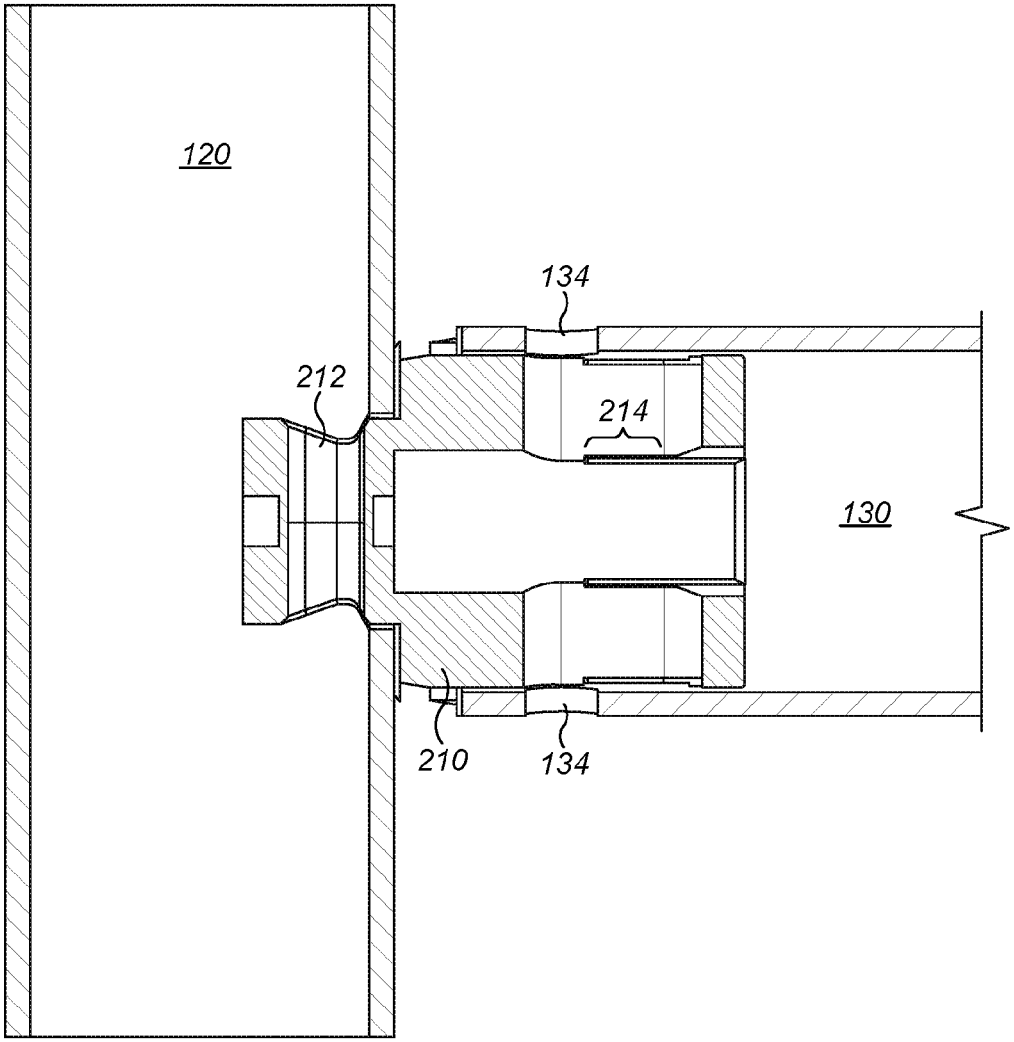
FIG. 3 shows a cross-sectional view through an exemplary coupling between a post and rail.

In the embodiments described above, the fixings are held substantially fast to the connector in a direction along an axis of the rail. This creates a rigid structure that attempts to prevent any movement of the rail away from the post. However, in at least impact barriers, it is advantageous for the barrier to include some movement at the joint in order to absorb some of the forces of the impact. Consequently, as shown in FIG. 3, the connector 210 includes a slot 214. The slot is larger than the fixing (not shown) and allows the fixing to move relative to the coupling. As shown the fixing and rail 130 remain static relative to each other as the fixing is held in holes 134 on either side of the rail. The slot 214 is filled with a material 216 having a reduced resistance to deformation. For instance, the slot 214 may be filled with a compressible material such as a foam or a deformable material such as rubber. If a deformable material is used, space within the slot will need to be kept free to enable the rubber to deform.

Figure 4A:
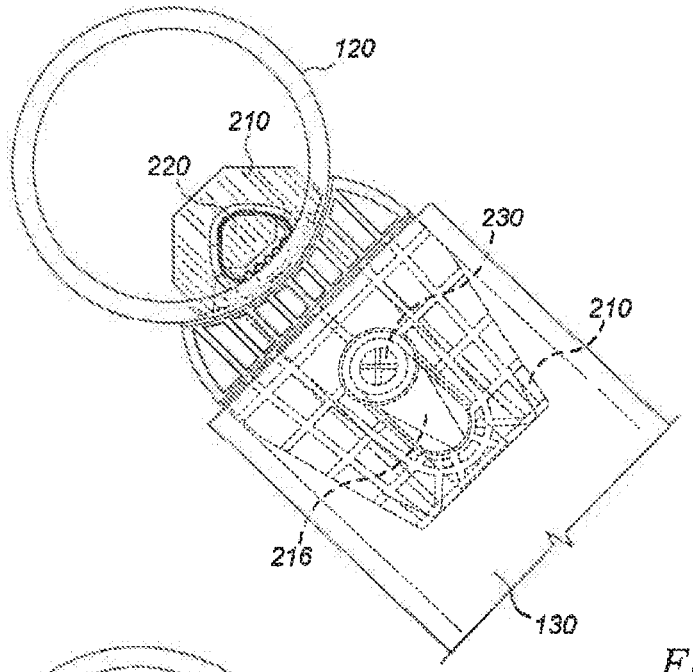
FIGS. 4A and 4B show a top view of FIG. 3 before and at a point of impact, respectively.
Figure 4B:
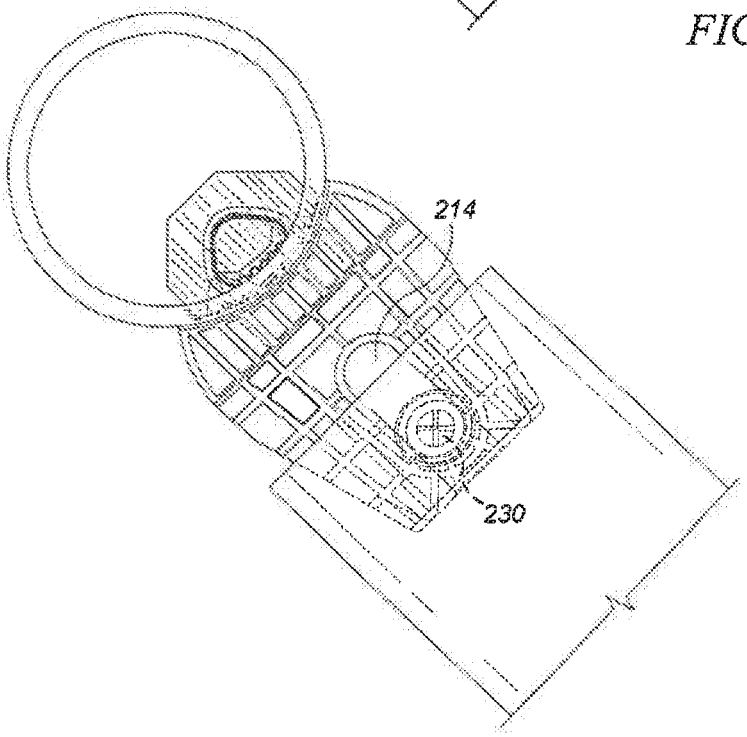

As will be appreciated, the coupling is shown in FIG. 3 as extending into the post. The first fixing (not shown) extends through aperture 212 to abut either side of the hole through which the coupling extends. Referring now to FIG. 4A, the barrier is shown in an initial rest position wherein the rail is secured to the post by the coupling comprising the connector held to the post and rail by respective fixings. As the barrier is impacted, the rail is caused to pull away from the post, as shown in FIG. 4B. The second fixing 230 is held statically relative to the rail and therefore moves with the rail. The first fixing causes an abutment with the inside of the post and therefore resists the connector from being pulled away from the post. Consequently the second fixing 230 is allowed to move by deformation of the material 216. The deformation controls the movement of the rail away from the post and the impact absorption can be changed by using different material characteristics. Once the material 216 has been fully deformed, the rail and fixing become locked together again and further movement of the rail away from the post need to be accommodated by failure or by the material characteristics of the post and rail or elsewhere in the system. If the material 216 is resilient, the barrier may return to the first state and not need replacing.

It will be appreciated that although the fixing has been described as being static to the rail with the coupling including the area of reduced resistance to deformation, the parts may be reversed wherein the fixing is static to the connector and the material 216 arranged within a slot in the rail.

Whilst the first fixing 220 may also be arranged to slip within one of the parts, the space within the post is often more limited. Consequently additionally or alternatively, a fixing 300 having an impact absorption feature as shown in FIG. 5 to FIG. 8, may be used as one or both of the fixings 220, 230 and separately or in addition to the slip movement feature.

Figure 5:
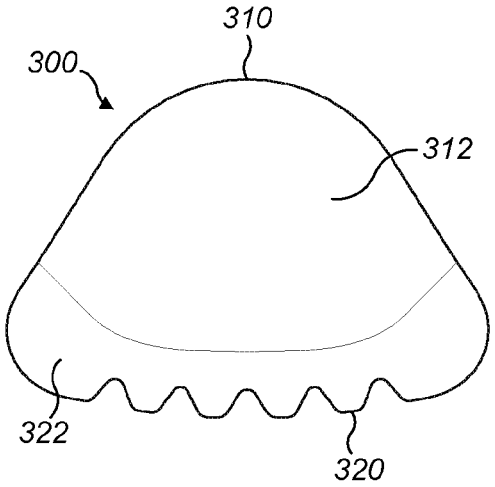
FIG. 5 shows a perspective view of an exemplary fixing.

FIG. 5 shows a first embodiment of a fixing member 300 arranged to prevent a first part of a barrier separating from a second part of the barrier. The fixing member 300 is shown with a first side 310 and a second side 320. The first side 310 of the fixing member 300 acts against one of the parts of the barrier. The fixing member 300 has a substantially constant cross-section and is particularly elongate and shaped like a prism, particularly a triangular prism. The corners of the prism are curved in order to improve the distribution of forces acting on and through the fixing member 300 towards the impact barrier. The second side 320 of the fixing member 300 is shown to substantially occupy one face of the prism whereas the first side 310 substantially covers two faces of the prism. In this embodiment, the first side 310 and second side 320 have different locating means. For instance, the first side 310 is located within the impact barrier by the two faces of the triangular prism whereas the second side 320 is located using a corrugated surface. The first side 310 of the fixing member 300 is formed from a first area 312 and the second side 320 of the fixing member 300 is formed from a second area 322 to produce the constant cross-section of the prism shape.

It can be appreciated that the fixing member 300 is composed of varying resistances to deformation to aid the absorption forces on impact. For instance, the first side 310 of the fixing member 300 has a high resistance to deformation, whereas the second side 320 has a relatively lower resistance to deformation. Therefore, it may be said that the first side 310 is rigid compared to a softer second side 320. When the fixing member 300 is slotted into position, the first side 310 of the fixing member 300 is pressed against the impact barrier which causes the softer second side 320 to compress and allow the two parts of the impact barrier to be secured.

During impact, and as the first and second parts are cause to produce a shearing effect on the fixing, movement of the first face towards the second face is controlled by deformation of the softer area and thereby absorbs some of the energy from the impact.

Figure 6:
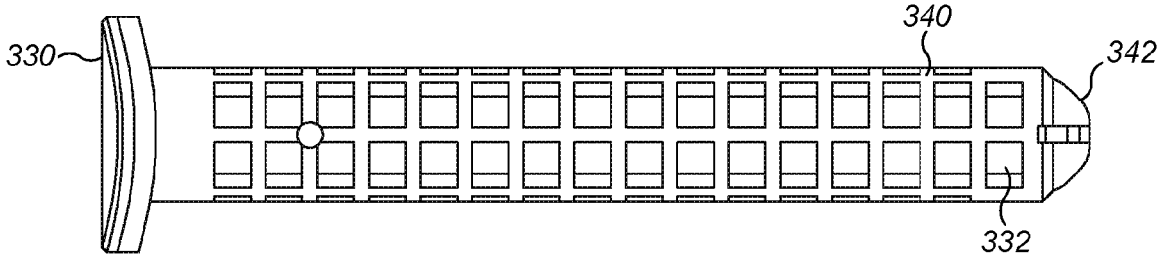
FIGS. 6 and 7 show perspective views of a rod and sheath respectively for forming a further exemplary embodiment of a fixing.
Figure 7:
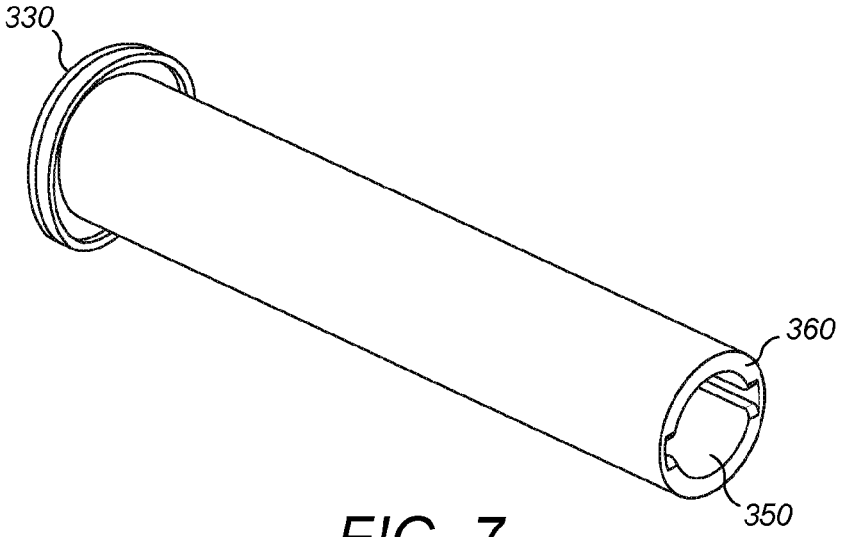

FIGS. 6 and 7 shows a second embodiment of the fixing member 300. The fixing member 300 is shown as an elongate member and is in the form of pin. The fixing member 300 is comprised of an inner core 330 and outer sheath 360. The fixing member includes varying resistances to deformation in order to improve the distribution of forces on impact. For instance, the inner core 330 has a relatively soft outer layer 340 with a low resistance to deformation and is coupled to a relatively harder inner layer 342 with a higher resistance to deformation. This varying resistances help to improve the transfer of forces through the fixing member 300. The outer layer 340 wraps around the inner layer 342 to allow the outer layer to consistently contact the impact barrier and more evenly distribute and absorb the impact forces. The outer layer 340 is shown as a mesh-like lattice structure with interconnecting cross-members and a plurality of recesses 332. These recesses 332 allow the relatively soft outer layer 340 to spread outwardly and towards each recess 332 in order to improve the deformation ability of the outer layer 340.

The sheath 360 comprises a relatively hard material that has a relatively higher resistance to deformation. On impact, the forces are absorbed through the hard outer layer 360 deforming and compressing the inner layer wherein said depression controls the movement of the first surface towards the second. The hard outer layer 360, elastically deforms in a controlled and restricted manner, which allows the fixing member 300 to compress to form an ovular, egg-like shape. The deformation or compression forces are distributed through the fixing member 300 radially and circumferentially so that the deformation is achieved more uniformly around the fixing member 300 and the force is not solely transferred through one side or face of the fixing member 300. In this embodiment, the soft inner core 350 is surrounding by the outer layer 360 which acts like a sleeve to wrap the core 350.

Figure 8:
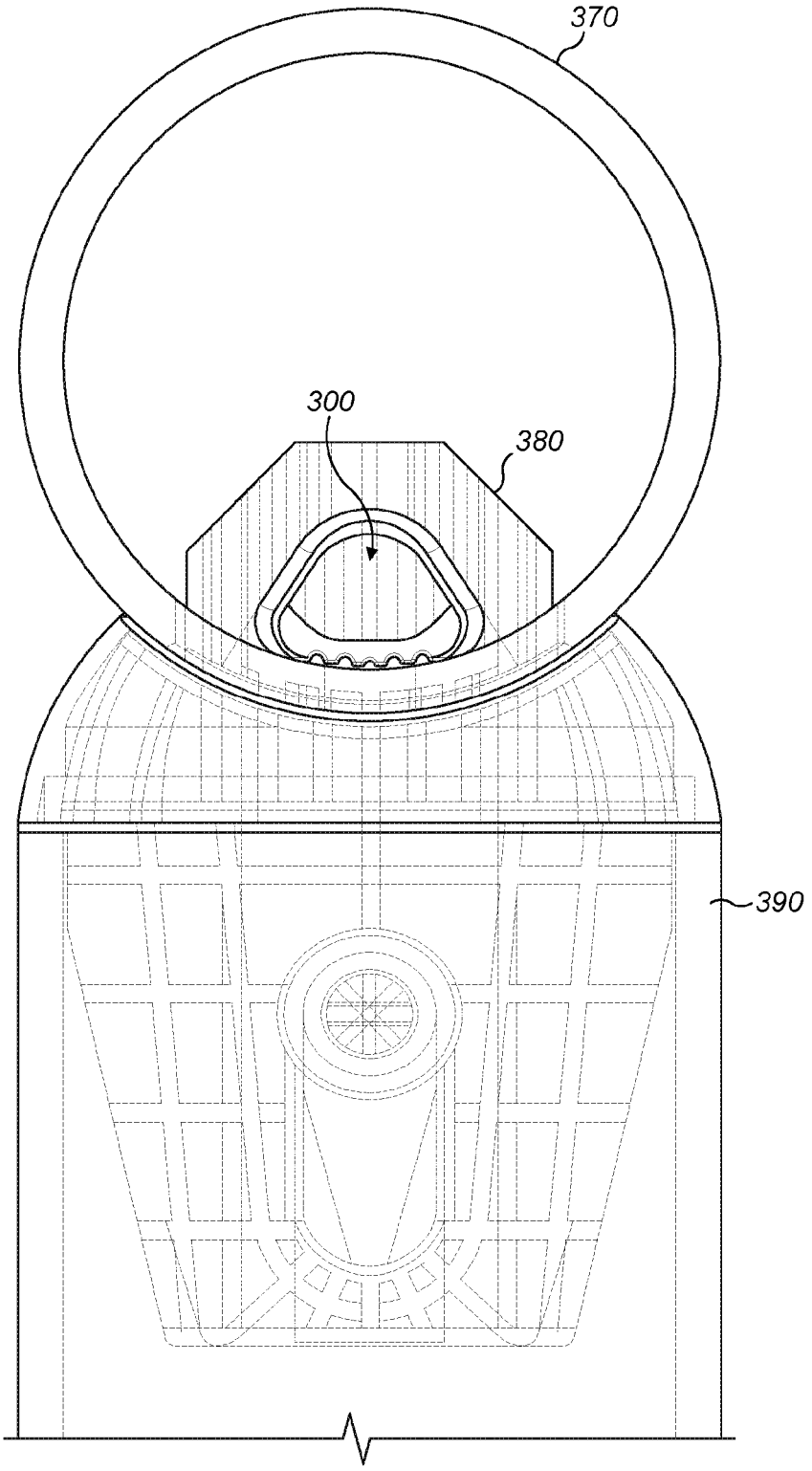
FIG. 8 shows a top view of a post and rail connection employing the fixing of FIG. 5.

FIG. 8 shows the fixing member 300 located within a tube 370 in order to hold the first part 380 of the impact barrier within the second part 390 of the impact barrier. Here, the fixing member 300 is slotted between the first part 380 and the tube 370 so that the first side 310 of the fixing member acts against the first part 380 of the impact barrier and the second side 320 of the fixing member 300 acts against the second part 390 of the impact barrier. On impact, the first part 380 is pulled from the second part 390 which causes the second side 320 of the fixing member 300 to deform. After the impact, if the material is resilient, the fixing member 300 returns to its original location. The second side 320 of the fixing member 300 acts longitudinally across the tube 370 so that the first part 380 and second part 390 are not easily detached from the tube 370. The fixing member 300 is press fitted so that when the impact barrier recoils after the impact, the fixing member 300 does not fall out or move away from its original position. It is appreciated that an end stop may be applied to the fixing member 300 in order to prevent any dislodging or downward movement.

Figure 9:
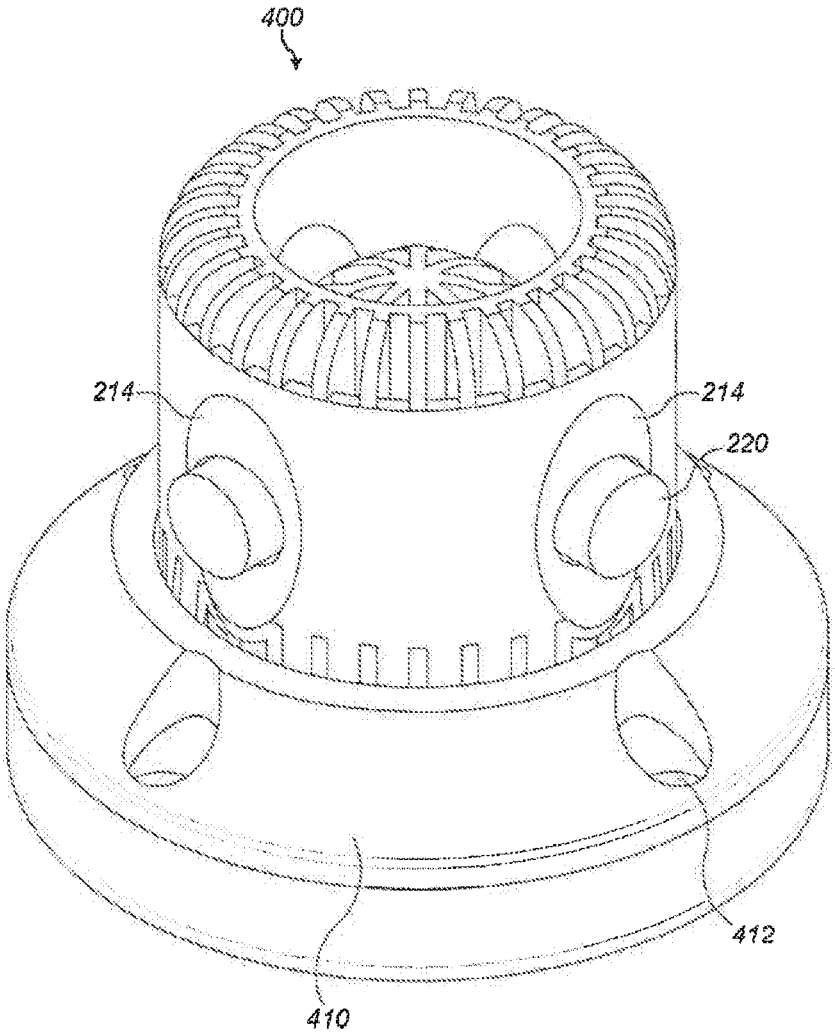
FIG. 9 shows a perspective view of an exemplary foot plate for connection to a post.
Figure 10:
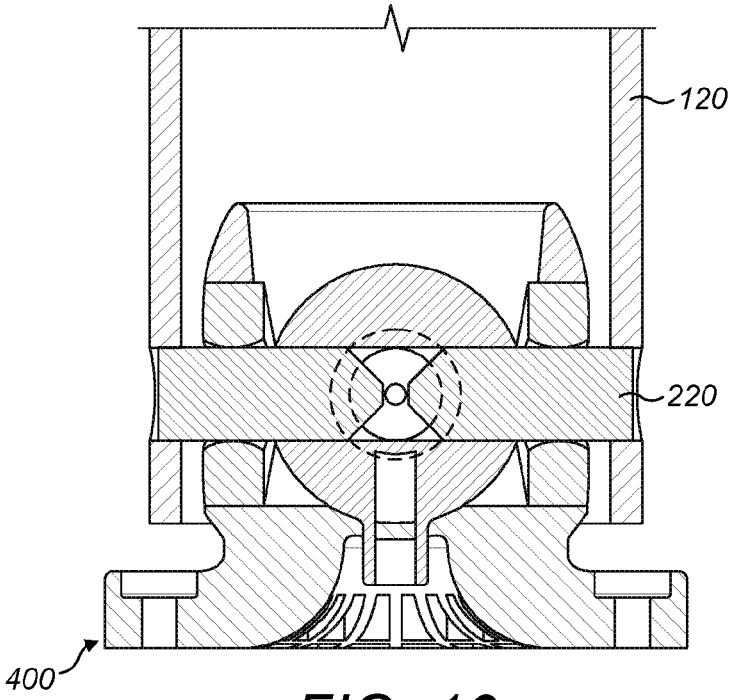
FIGS. 10 and 11 show a cross-sectional view through a post connected to the foot plate of FIG. 9 and respectively before and during a point of impact.
Figure 11:
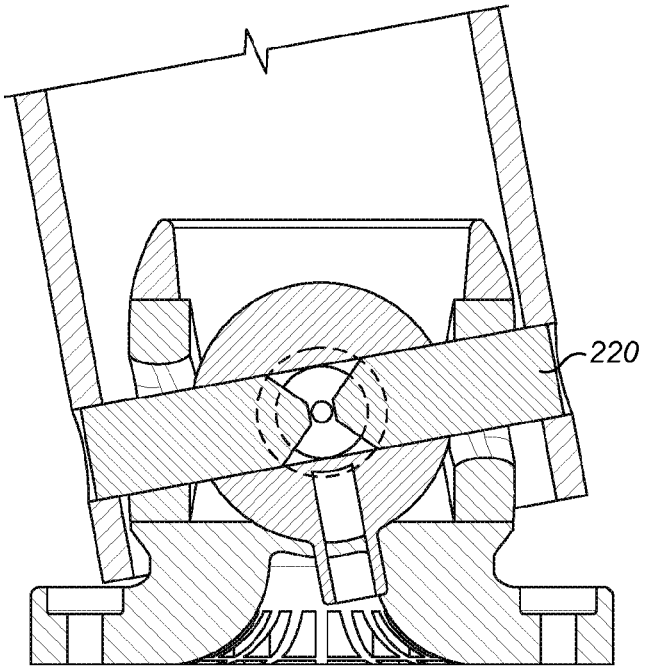

Referring to FIG. 9, a foot plate 400 is shown by way of example to illustrate a further exemplary embodiment. It will however be appreciated that the connection may apply equally to a post and rail connection. The foot plate 400 assembled to a post 120 is shown in FIGS. 10 and 11. A fixing such as an elongate pin secures the post to the footplate, wherein the foot plate has been inserted into the post. In the previous embodiments, the pin was in contact with an area of reduced resistance to deformation only to one side of the shear force acting on the pin. This provides good control of lateral movement, but during impact often a bending moment is also created. Whilst the previous embodiments allowed the post to pivot, the pivot point is not at a centre of the post. Consequently it is advantageous as shown to provide an area of reduced resistance to deformation on both sides of the pin. As shown, the pin therefore extends through an aperture as before in the post and maintain a static relationship with the post. The pin extends through the foot plate. Slots extend either side of the pin in which the softer material is placed as herein described. Consequently as the shearing force causes the pin to lift on one side, the same shearing force causes the other side of the pin to move downwardly. The pin therefore pivots towards a centre of the footplate 400.

In the Figures the pin 220 is formed in two parts. The two parts remain connected by a ball. This allows a second pin to be inserted through the footplate at an angle but on the same plane as the first pin. Consequently, the post is able to pivot due to the compression of a soft area in two directions.

Referring back to FIG. 9, the foot plate therefore comprises a body 410 including ground anchor fixing points 412 so that the foot plate can be securely fastened to the ground. The body includes a generally cylindrical part that up stands from a base and is inserted into the post. Once inserted, pins 220 are inserted through the apertures on the post, the slots in the base plate and so that parts of the pins extend between the post and base plate at four positions. Slots within the base plate are filled with a softer material so as to absorb energy during impact.

Figure 12:
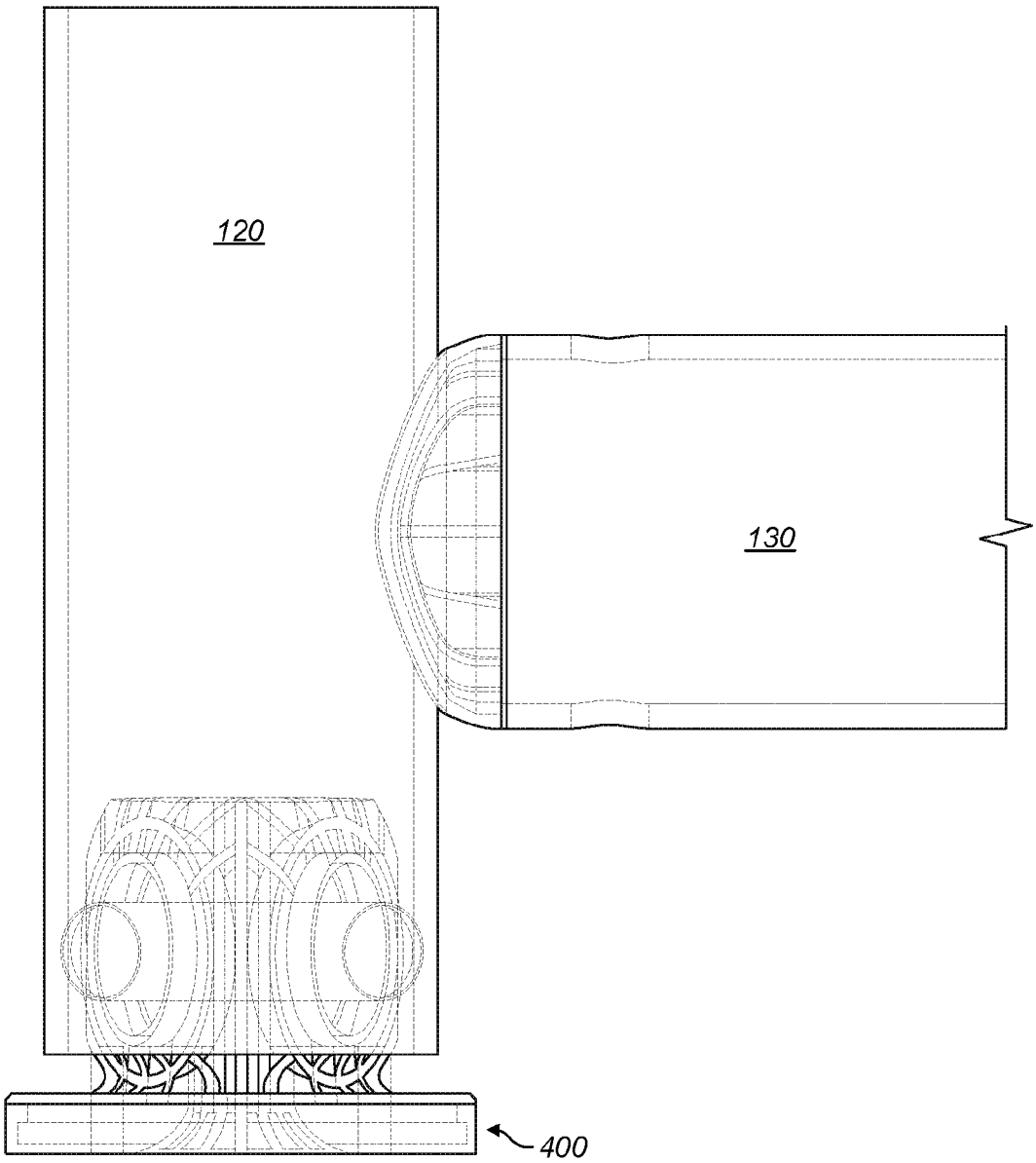
FIG. 12 shows a side view of an exemplary barrier.

As shown in FIG. 12, a predominantly plastic barrier is therefore provided having adequate strength between the footplate and post and rail and post to withstand and provide protection against impacts. The barriers are aesthetically pleasing as seamless designs can be utilised wherein the rail and posts are substantially equally sized. Here a collar is formed on the connector so that square end posts can be used without creating gaps in the seamless appearance.

The foregoing embodiments have been described in relation to an impact barrier. Such barriers are designed to withstand the dynamic forces generated by an impact. Often, such barriers have to conform to specific standards set by the rules, regulations and best practices of each country. For instance, rules governing amounts of deflection acceptable from given loads. However, it will be appreciated that the barrier system described herein may also be adaptable to other barrier systems. For instance, safety barriers other than impact barriers such as balustrading that is designed to withstand static loading. Here static loading may be applied during a person leaning against the barrier. The barrier system offers a safety barrier having the advantages outlined above such as ease of assembly, ease of replacement, better force distribution, and common size post and rail giving seamless joins. Moreover, there are other barriers such as segregation barriers and partition barriers where the barrier system described herein can be adapted to produce advantageous affects.

Although a few preferred embodiments have been shown and described, it will be appreciated by those skilled in the art that various changes and modifications might be made without departing from the scope of the invention, as defined in the appended claims.

The invention claimed is:

1. A barrier assembled from parts, the parts comprising:

first and second spaced posts; and a rail interconnecting said first and second posts, wherein the rail is not inserted within the posts;

wherein the first post, the second post, and the rail are hollow in at least a hollow region of the intended interconnection and each post includes an aperture and is connected to the rail by a coupling, wherein the coupling includes a connector;

the connector is arranged to extend through the aperture so that a first portion of the connector is arranged inside the hollow region of the post and a second portion of the connector is arranged inside the hollow region of the rail, the first portion and the second portion being a single piece;

a width of the first portion is smaller than a width of the second portion such that the second portion is configured to abut the post and cannot extend through the aperture into the hollow region of the post; and the connector includes an abutment that is able to be arranged to prevent movement of the connector through the aperture in use while the second portion abuts the post and includes a second abutment arranged to act through an aperture within the rail;

wherein the connector comprises a main body and a moveable first fixing, the first fixing is removable from the main body; and the first fixing is arranged from an abutment position to a free position, and in the abutment position, the moveable first fixing forms the abutment; and the connector is moveable relative to the rail so that, when the abutment is removed from the main body of the connector, the connector is able to move through the aperture in a direction to withdraw the first portion into only the hollow region of the rail while being fixed by the hollow region of the rail in all directions perpendicular to the direction so that the rail can subsequently be disassembled from the posts without increasing the distance between the two spaced posts, and when the abutment is in the abutment position and the second abutment is fixed to the rail, the connector is moveable relative to the hollow region of the rail to extend from the rail.

2. The barrier as claimed in claim 1, wherein the abutment of the connector is arranged within the post.

3. The barrier as claimed in claim 2, wherein the abutment is arranged to contact the inside of the post.

4. The barrier as claimed in claim 2, wherein the abutment is in removable contact with the inside of the post.

5. The barrier as claimed in claim 4, wherein the abutment is arranged to restrict in size in order to pass through the aperture.

6. The barrier as claimed in claim 1, wherein the first fixing is an elongate pin.

7. The barrier as claimed in claim 1, wherein the second portion of the coupling has a length great enough that the second portion of the coupling is configured to remain retained within the rail upon impact of an object with the barrier.

8. The barrier as claimed in claim 1, wherein the aperture through the post is smaller than an inner dimension in the rail, the inner dimension being arranged to enclose the second portion of the coupling.

9. The barrier as claimed in claim 1, wherein the second abutment is removable.

10. The barrier as claimed in claim 1, further comprising a collar arranged to fit against the rail to one side and the post to the other.

11. The barrier as claimed in claim 1, the first fixing is within the hollow region of the post when the first fixing is in the abutment position.

12. The barrier as claimed in claim 1, the connector comprises a slot through which the second abutment extends when fixed to the rail, the slot allowing the connector to move relative to the second abutment and the hollow region of the rail.

13. A method of assembling and disassembling a barrier from parts, the method of assembly comprising:

providing a connector having a first portion and a second portion, the first portion and the second portion being a single piece, and a width of the first portion being smaller than a width of the second portion;

interconnecting a rail to a first post and a second post, wherein the rail is not inserted within the posts, wherein the first post, the second post, and the rail are hollow in at least a hollow region of the intended interconnection and each post includes an aperture;

the method of interconnection comprising:

coupling each post to the rail by the connector;

arranging the connector through the aperture so that the first portion of the connector is arranged inside the hollow region of the post and the second portion of the connector is arranged inside the hollow region of the rail, such that the second portion is configured to abut the post and cannot extend through the aperture into the hollow region of the post;

preventing movement of the connector through the aperture by an abutment arranged on the connector while the second portion abuts the post and simultaneously allowing the connector to move relative to the hollow region of the rail to extend from the rail; and wherein the connector comprises a main body and a moveable first fixing, the first fixing is removable from the main body;

the first fixing is arranged from an abutment position to a free position, and in the abutment position, the moveable first fixing forms the abutment; and a second fixing extends through the connector and the rail and is fixed to the rail to form a second abutment for the connector;

the method of disassembly comprising:

disassembling the rail from each post by removing the abutment from the main body of the connector and allowing movement of the connector through the aperture in a direction to withdraw the first portion into only the hollow region of the rail while being fixed by the hollow region of the rail in all directions perpendicular to the direction such that the rail can be disassembled from the posts without increasing a distance between the two posts.

14. The method as claimed in claim 13, the first fixing is within the hollow region of the post when the first fixing is in the abutment position.

15. The method as claimed in claim 13, the connector comprises a slot through which the second fixing extends, wherein the slot allows the connector to move relative to the second fixing and the hollow region of the rail.

* * * * *